US005713066A

United States Patent [19]

Takekoshi et al.

[11] Patent Number: 5,713,066

[45] Date of Patent: Jan. 27, 1998

[54] IMAGE FORMING APPARATUS FEATURING AN ELECTRIC FIELD REGULATING MEMBER PROVIDED ON AN OPPOSING SURFACE OF A CONDUCTIVE SUBSTRATE

[75] Inventors: Rie Takekoshi; Nobuhiko Takekoshi, both of Kawasaki, Japan

[73] Assignee: Canon Kabushiki Kaisha, Tokyo, Japan

[21] Appl. No.: 648,859

[22] Filed: May 16, 1996

[30] Foreign Application Priority Data

May 19, 1995 [JP] Japan ..... 7-145720

[51] Int. Cl.[6] ..... G03G 15/00; G03G 15/16

[52] U.S. Cl. ..... 399/121; 399/308

[58] Field of Search ..... 355/274, 271; 399/66, 121, 297, 302, 308

[56] References Cited

U.S. PATENT DOCUMENTS 5,198,863 3/1993 Goto et al. ..... 355/274
5,227,851 7/1993 Yoshida et al. ..... 355/217
5,233,395 8/1993 Kohyama ..... 355/274
5,249,022 9/1993 Watanabe et al. ..... 355/271

FOREIGN PATENT DOCUMENTS 4186387 7/1992 Japan .

*Primary Examiner*—Arthur T. Grimley
*Assistant Examiner*—Quana Grainger
*Attorney, Agent, or Firm*—Fizpatrick, Cella, Harper & Scinto

[57] ABSTRACT

An image forming apparatus includes an image bearing member, a recording material bearing member for bearing and conveying a recording material to a transfer position, and a transfer charge member for transferring an image from the image bearing member onto the recording material born on the recording material bearing member. The transfer charge member has a plate-shaped conductive substrate and is contacted with a surface of the recording material bearing member opposite to a surface for bearing the recording material at the transfer position.

34 Claims, 4 Drawing Sheets

IMAGE FORMING APPARATUS FEATURING AN ELECTRIC FIELD REGULATING MEMBER PROVIDED ON AN OPPOSING SURFACE OF A CONDUCTIVE SUBSTRATE

BACKGROUND OF THE INVENTION

1. Field of the Invention

The present invention relates to an image forming apparatus in which an image is formed on an image bearing member and the image is then transferred onto a recording material conveyed by a recording material bearing member. The image forming apparatus according to the present invention is suitable for application to an electrophotographic recording apparatus, in particular, an electrophotographic color copying machine and an electrophotographic color printer in which plurality different color toner images are successively formed on an electrophotographic photosensitive member such as an image bearing member and the toner images are successively transferred on the same recording material.

2. Related Background Art

In conventional electrophotographic color image forming apparatuses, a color toner image is formed on a photosensitive drum, and the color toner image is transferred onto a recording material supported by a recording material bearing member such as a transfer drum or a transfer belt, by means of a transfer charger.

With the arrangement as mentioned above, in order to accurately transfer the toner image on the photosensitive drum onto the recording material, the Japanese Patent Laid-open Application No. 4-186387 (1992) proposed a technique in which a transfer electric field is shielded in the vicinity of and upstream of a contact position between a transfer drum and a photosensitive drum in a recording material conveying direction. By doing so, toner particles can be prevented from scattering from a toner image on the photosensitive drum and the toner image can correctly be transferred onto the recording material.

To this end, there has been widely used a technique in which an electric field regulating member is provided upstream of a transfer charger. For example, as shown in FIG. 4, an electric field regulating member 66 is disposed upstream of a corotron charger (transfer charger of non-contact type) 62, or, as shown in FIG. 5, a regulating member 86 is disposed upstream of a plate-shaped conductive substrate (conductive blade) 84 of a transfer charge member (transfer charger of contact type) 80. The electric field regulating members 66, 68 are elastically flexed toward a photosensitive drum 1 from an upstream side to a down stream side in a shifting direction of a transfer belt 8 in such a manner that the regulating members are urged against the photosensitive drum 1 via the transfer belt 8. In FIG. 5, the reference numeral 82 denotes an electrode for applying a transfer voltage to the blade 84.

However, during the transferring, if the contacting pressure between the recording material and the photosensitive drum is too strong, since the toner on the photosensitive drum is compressed against the photosensitive drum, the toner image is not transferred to the recording material, thereby causing a poor transferring phenomenon that the toner remains on the photosensitive drum. Thus, it is preferable that the electric field regulating member and the transfer charge member are urged against the transfer drum with lowest possible pressure. To this end, as shown in FIG. 6, a transfer charge member 90 having a relatively thick plate-shaped conductive substrate (conductive blade) 94 is provided in such a manner that the blade is not elastically flexed but is inclined toward a photosensitive drum 1 from an upstream side to a down stream side in a shifting direction of a transfer belt 8 so that an upstream corner of the blade 94 is urged against the photosensitive drum 1 via the transfer belt 8. In FIG. 6, the reference numeral 98 denotes a lubricating layer provided on an upstream surface of the blade 94; and 96 denotes an electric field regulating member provided upstream of the blade 94 via the lubricating layer 98.

By providing such a transfer charge member 90, a light pressure contact between the transfer charge member and the photosensitive member 1 can be achieved and the photosensitive drum 1 can be charged uniformly, and, since the construction is simpler than the corotron charger 62 shown in FIG. 4, the transfer charge member 90 has recently been used widely. However, in the transfer charge member 90 shown in FIG. 6, since the transfer electric field is regulated by the electric field regulating member 96 particularly upstream of the transfer charge member, the transfer electric field is shifted toward the downstream side of the transfer charge member, with the result that, downstream of a contact position (transfer nip) between the transfer drum 8 and the blade 94, the toner scattering on the recording material occurs due to the discharge from the surface of the blade 94 opposed to the photosensitive drum 1, thereby causing the poor image transferring.

This problem also occurs in the case where a second image bearing member (intermediate transfer member) is rotated while being contacted with a first image bearing member (photosensitive drum) and a toner image on the photosensitive drum is transferred onto the intermediate transfer belt by a transfer charge member contacted with a back surface of the intermediate transfer belt.

SUMMARY OF THE INVENTION

An object of the present invention is to provide an image forming apparatus in which the discharge from a transfer charge member is suppressed downstream of a contact position between a recording material bearing member and the transfer charge member in a shifting direction of the recording material bearing member, thereby achieving the good transferring.

Another object of the present invention is to provide an image forming apparatus in which the discharge from a transfer charge member is suppressed downstream of a contact position between a second image bearing member (intermediate transfer member) and the transfer charge member in a shifting direction of the second image bearing member, thereby achieving the good transferring.

The other objects and features of the present invention will be apparent from the following description referring to the accompanying drawings.

DETAILED DESCRIPTION OF THE PREFERRED EMBODIMENTS

Figure 1:
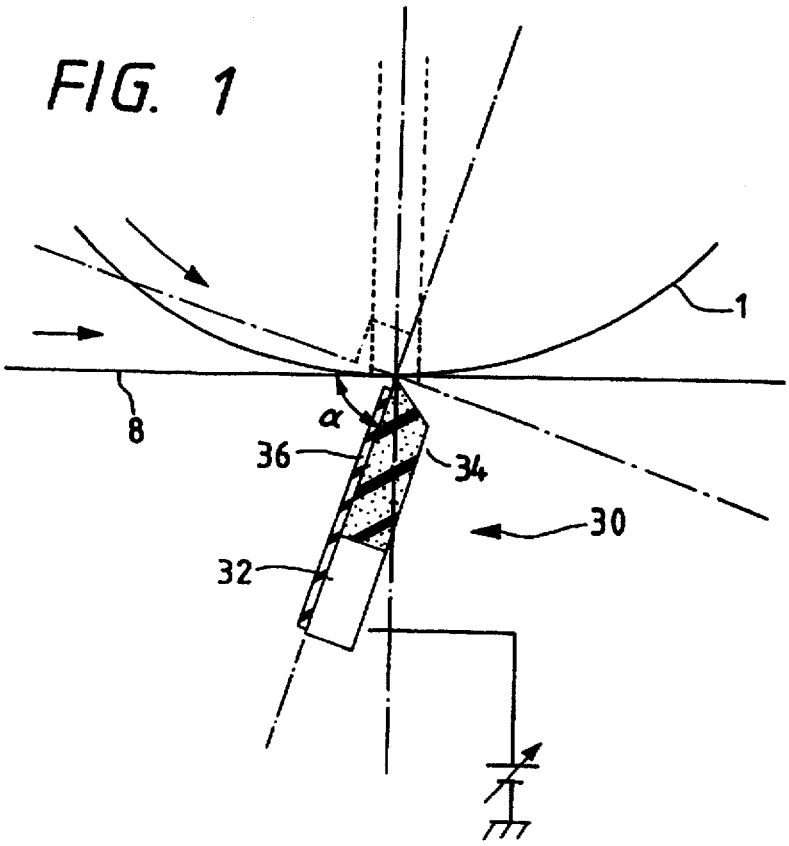
FIG. 1 is a sectional view showing a transfer portion according to a preferred embodiment of the present invention.

FIG. 1 is a sectional view showing a transfer portion according to a preferred embodiment of the present invention, which is a general example of a transfer portion of the present invention. In this embodiment, the transfer charge member will be explained in the case where it is applied to an electrophotographic color recording apparatus shown in FIG. 3. The electrophotographic color recording apparatus shown in FIG. 3 has a single image forming portion.

The image forming portion includes a photosensitive drum (image bearing member) 1 around which there are disposed an exposure lamp 21, a charger 2, a light source (not shown), a polygon mirror 17 for scanning light emitted from the light source, and a potential sensor (not shown) for detecting a surface potential of the photosensitive drum 1. The light emitted from the light source in response to an image signal representative of color component of an image is scanned by rotating the polygon mirror 17, and the scanned light is deflected by a reflection mirror and then is focused on the generatrix of the photosensitive drum 1 through an fθ lens. In this way, latent images corresponding to color components of the image are successively formed on the photosensitive drum 1 in response to the image signals.

A rotating developing means 3 is disposed at a side of the photosensitive drum 1. The developing means 3 includes an yellow developing device 3*a*, a magenta developing device 3*b*, a cyan developing device 3*c* and a black developing device 3*d* which are mounted on a rotary member. The developing devices 3*a*, 3*b*, 3*c* and 3*d* contain therein yellow toner, magenta toner, cyan toner and black toner which are supplied from respective toner supply devices, respectively. In the rotating developing means 3, by rotating the developing devices 3*a* to 3*d*, the developing devices corresponding to the latent images on the photosensitive drum 1 are successively brought to a developing position where the selected developing device is opposed to the photosensitive drum, thereby developing the latent images successively.

A transfer drum (recording material bearing member) 8 is disposed at a right and lower side of the photosensitive drum 1. The transfer drum 8 comprises a pair of end ring portions, a frame for interconnecting the ring portions, and a dielectric sheet for covering an opening defined by the frame and for supporting a recording material. A recording material 6 supplied from a recording material cassette 60 is conveyed to the transfer drum 8 through a pair of regist rollers 13 and the like. The transfer drum 8 is constituted by mounting the dielectric resin film made of polyethylene terephthalate (PET), polyvinylidene fluoride or polyurethane around the frame interconnecting the end ring portions to define a drum shape.

Now, an operation of the color image forming apparatus will be briefly explained in connection with four color image formation. While the photosensitive drum 1 is being rotated, a surface of the photosensitive drum is uniformly charged by the charger 2. Then, the laser beam modulated by the image signal corresponding to a first color of an original (yellow color component) is illuminated on the photosensitive drum 1, thereby forming the electrostatic latent image corresponding to the yellow color component on the photosensitive drum 1. This latent image is developed by the yellow developing device 3*a* previously positioned at the developing position, thereby forming a yellow toner image on the photosensitive drum 1.

On the other hand, the recording material 6 supplied from the cassette 60 is conveyed to the transfer drum 8 by the pair of register rollers 13 and the like, and then, the recording material is shifted along with the transfer drum 8. At the same time, an absorption roller of an absorption charge means 12 (which further includes an absorption charger) is urged against the surface of the transfer drum 8 to electrostatically hold the recording material 6 on the transfer drum 8 by absorbing the recording material by means of the absorption charger from the back side of the transfer belt. The transfer belt 8 is rotated in a direction shown by the arrow in synchronous with the photosensitive drum 1, thereby conveying the recording material 6 to the transfer portion where the transfer drum is opposed to the photosensitive drum 1. The yellow toner image is transferred onto the recording material 6 conveyed to the transfer portion, by the transfer charge means 4. The transfer drum 8 continues to rotate for preparing for the transferring the next magenta toner image.

After the transferring of the yellow toner image is finished, the residual toner remaining on the photosensitive drum 1 is removed by the cleaning member 5. Then, similarly, the magenta toner image is formed on the photosensitive drum 1 by illuminating the laser beam to form the latent image and by developing the latent image, and then, the magenta toner image is transferred onto the yellow toner image on the recording material 6 supported by the transfer drum 8 in a superimposed fashion.

Similar transferring operations are performed for cyan and black colors, with the result that the four color (yellow, magenta, cyan and black) toner images are transferred to the recording material 6 in the superimposed fashion, thereby obtaining a full-color image. The recording material 6 to which the four color toner images have been transferred is separated from the transfer drum by a separation pawl, and the separated recording material is sent to a fixing device 7 by a convey belt and the like.

The fixing device 7 comprises a fixing roller 71, a pressure roller 72, heat-resistance cleaning members 73, 74 for cleaning the rollers 71, 72, heaters disposed within the rollers 71, 72, a coating roller 77 for coating mold releasing agent such as dimethyl silicone oil onto the fixing roller 71, and a thermistor 79 for controlling a fixing temperature. In the fixing device 7, while the recording material 6 is being passed between the fixing roller 71 and the pressure roller 72, the color toner images are fused and mixed by heat and pressure and are fixed to the recording material 6, thereby obtaining a full-color print image.

After electricity is removed by electricity removal chargers 14, 15, the residual toner remaining on the transfer drum 8 is removed by a rotating fur brush 16. The residual toner removing means may be a blade, or a non-woven fabric, or the combination thereof.

Embodiment 1

A transfer portion according to a first embodiment is shown in FIG. 1.

A transfer charge member 30 shown in FIG. 1 includes an electrode 32, and a plate-shaped conductive substrate (conductive blade) 34 mounted on the electrode. A thickness of the conductive substrate is 500 μm to 5 mm, and, preferably, 1.0 to 2.0 mm. The plate-shaped conductive substrate or conductive blade 34 has a thickness along a shifting direction of the transfer belt 8 and is inclined from an upstream to a downstream in the shifting direction of the transfer belt 8 to extend toward the photosensitive drum 1 so that a tip end of the blade is urged against the photosensitive drum 1 via the transfer belt 8. That is to say, the transfer charge member 30 is urged against the transfer drum 8 in a normal direction with respect to the shifting direction of the transfer belt 8. In other words, an upstream angle between the transfer charge member and the transfer drum is an acute angle. Except for a tip end corner (edge portion) of the blade 34, a regulating member 36 for regulating a transfer electric field at an upstream side is provided on an upstream surface of the blade 34.

According to this embodiment, as shown in FIG. 1, the conductive blade 34 has an upstream tip end corner having an acute angle in the plane perpendicular to the generatrix of the drum 1. In the illustrated embodiment, while the acute angle of the upstream tip end corner of the blade 34 is selected to 45 degrees, the present invention is not limited to such an angle. Further, the blade 34 is urged against the transfer drum 8 at an upstream angle $\alpha$ of 60° to 65° between the blade 34 and an upstream tangential line tangent to the photosensitive drum 1 at a contact position between the blade and the photosensitive drum. In the illustrated embodiment, the total pressure of the transfer charge member against the transfer drum is selected to 750 grams.

The conductive blade 34 is made of SBR (styrene butadiene rubber), BR (butadiene rubber), EPDM (ethylene propylene diene tri-copolymer), urethane rubber, Si rubber, chloroprene rubber or epichlorohydrin rubber, which includes carbon black or pigment as conductive filler. By adding the conductive filler, the volume resistivity of the blade is selected to have any value within a range of $10^2$ to $10^{10}$ Ω.cm. Hardness of the blade 34 is preferably 20° to 80° (JIS-A), and, more preferably, 40° to 60°.

Figure 5:
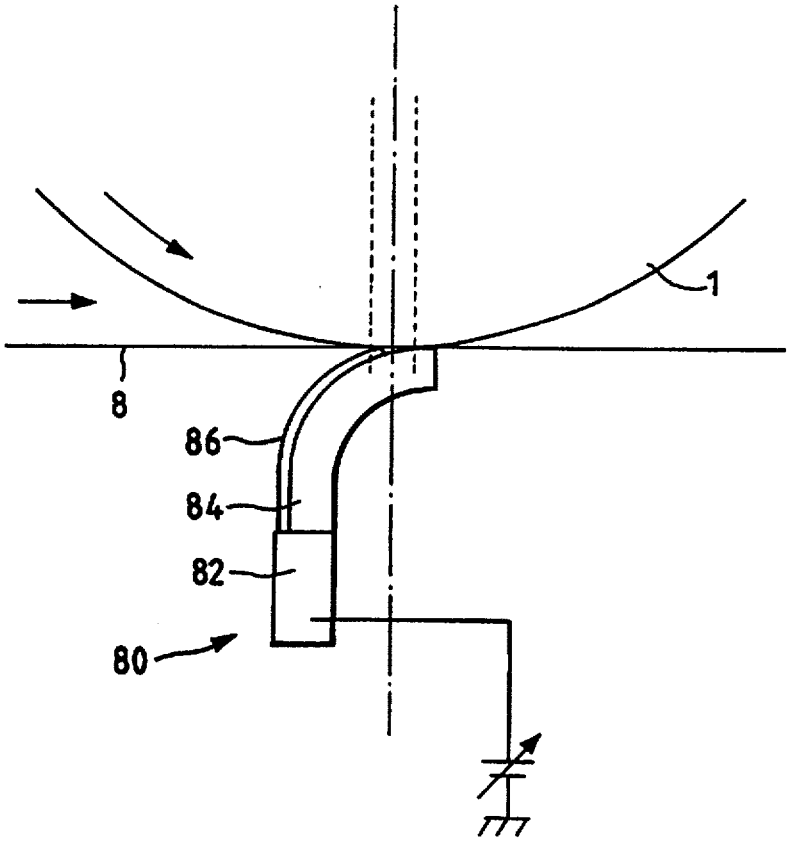
FIG. 5 PRIOR ART
FIG. 5 is a sectional view of a conventional transfer portion using a transfer charge member of contact type.

In order to urge the conductive blade 34 against the photosensitive drum in a flexed condition as shown in FIG. 5, it is necessary to increase the urging force of the blade or decrease the hardness of the blade. However, if the urging force is increased, the toner will not be transferred onto the recording material at a central portion in a width-wise direction of a line image extending in a conveying direction of the recording material thereby to cause the transfer void in the image, or the transfer drum 8 and/or the photosensitive drum 1 will be damaged, or the blade will be worn, or color deviation will be generated. If the hardness of the blade is decreased, the pressurizing becomes unstable due to the creep feature or the contact position is changed or deviated, thereby deteriorating the endurance. The total pressure of the transfer charge member against the dielectric sheet of the transfer drum is preferably 100 to 1200 grams.

Figure 6:
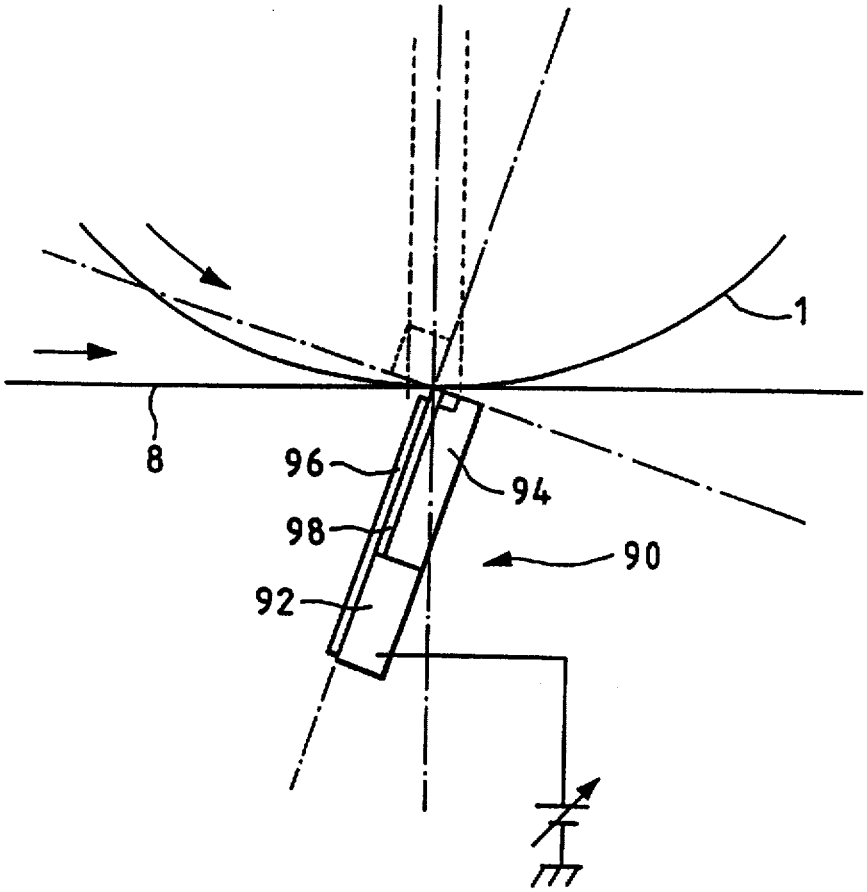
FIG. 6 PRIOR ART
FIG. 6 is a conventional transfer portion using another transfer charge member of contact type.

To this end, although it is preferable that the blade is urged against the transfer drum in a condition shown in FIG. 6 that the upstream corner of the blade is line-contacted with the transfer drum, since a distance between the upstream and downstream tip end corners of the blade is small, a discharge is generated at the downstream side of the transfer nip, with the result that the charging occurs. In this case, if the discharge at the upstream side of the transfer nip is great, the toner image formed on the photosensitive drum 1 will be scattered before it is contacted with the recording material, thereby deteriorating the sharpness of the transferred image. Further, in order to prevent the scattering of toner, when the electric field regulating member is provided at the upstream of the transfer charge member, since the transfer electric field is regulated by the electric field regulating member particularly at the upstream side of the transfer charge member, the transfer electric field is shifted toward the downstream, with the result that the discharge is increased in the vicinity of and downstream of the transfer nip.

To avoid this, in the illustrated embodiment, the upstream tip end corners (among two tip end corners) of the conductive blade 34 of the transfer charge member 30 is designed so that it has an acute angle, thereby constituting a transfer electric field shielding means for shielding the transfer electric field at the downstream side of the transfer nip. By using the blade 34 with the upstream tip end corner having the acute angle, the blade 34 is contacted with the photosensitive drum 1 via the transfer drum 8 only at the transfer nip, with the result that, since the charge acting area can be limited to small zone, the discharge at the downstream side of the transfer nip can be suppressed, thereby permitting uniform and light pressure contact between the transfer charge member and the transfer drum.

The upstream electric field regulating member 36 is formed from an insulation (dielectric) plate or film member and is preferably made of polyethylene terephthalate (PET), polycarbonate or acrylonitrile butadiene styrene (ABS). The regulating member 36 is not necessarily contacted with the photosensitive drum 1 (member to be charged) but may be disposed upstream of the upstream surface of the blade 34 (except the upstream tip end corner thereof), i.e., in the vicinity of and the upstream of the transfer nip.

Embodiment 2

Figure 2:
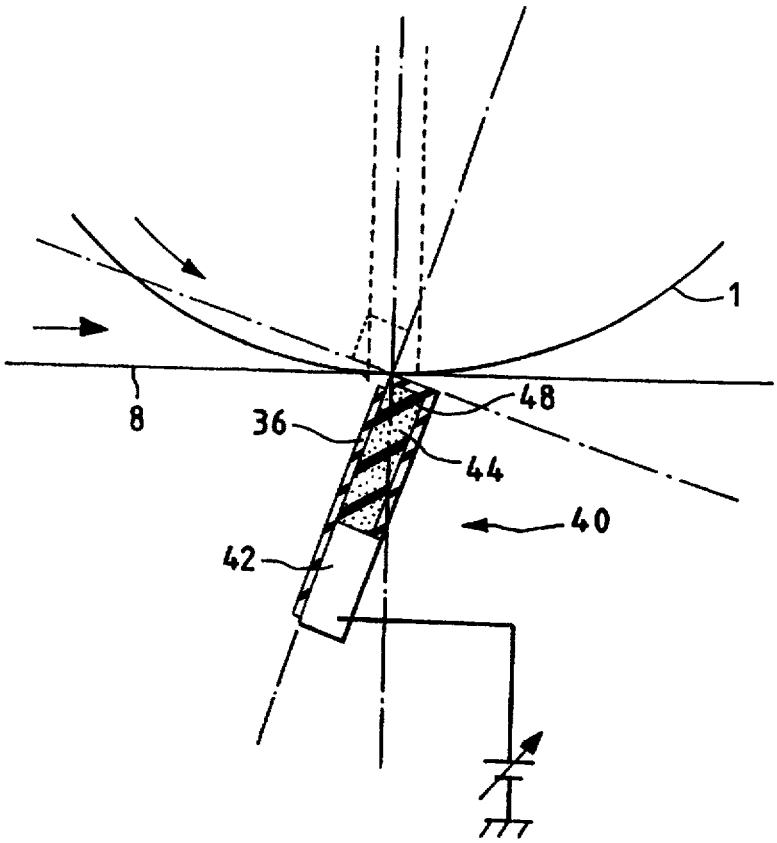
FIG. 2 is a sectional view showing a transfer portion according to another embodiment of the present invention.

FIG. 2 is a sectional view of a transfer portion according to a second embodiment of the present invention. In the embodiment 1, while an example that the downstream electric field shielding means is constituted by forming the upstream tip end corner of the transfer charge member at the acute angle was explained, it is not necessary that the upstream tip end corner of the transfer charge member is formed at the acute angle, but, an electric field shielding means may be constituted as follows.

According to this second embodiment, as shown in FIG. 2, a conductive blade (plate-shaped conductive substrate) 44 mounted on an electrode 42 of a transfer charge member 40 has a dielectric layer 48 disposed on an opposed surface (opposed to the photosensitive drum 1) extending between an upstream tip end corner (contacted with the photosensitive drum 1) and a downstream tip end corner of the blade and a downstream surface (extending between the downstream tip end corner and a blade supporting portion) of the blade, and the dielectric layer 48 constitutes a downstream electric field shielding means for shielding the electric field at the downstream side of the transfer nip.

As is in the embodiment 1, the conductive blade 44 has a thickness along the shifting direction of the transfer drum 8 and is inclined from an upstream side to a downstream side in the shifting direction of the transfer belt 8 to extend toward the photosensitive drum 1 so that a tip end of the blade 44 is urged against the photosensitive drum 1 via the transfer belt 8. An upstream regulating member 46 for regulating the transfer electric field is provided on an upstream surface of the blade 44 except the upstream tip end corner of the blade. The blade 44 may be made of the same material as that of the blade 34 in the embodiment 1. The thickness of the conductive substrate is 500 μm to 5 mm, and, preferably, 1.0 to 2.0 mm. The total pressure of the transfer charge member against the dielectric sheet of the transfer drum is preferably 100 to 1200 grams. Hardness of the blade is preferably 20° to 80° (JIS-A), and, more preferably, 40° to 60°.

In this embodiment, while an example that the dielectric layer 48 is disposed on the opposed surface and the downstream surface of the blade 44 was explained, the dielectric layer may be or not may be provided on the downstream surface of the blade, so long as the opposed surface of the blade 44 between the vicinity of the upstream tip end corner (transfer nip) and the downstream tip end corner is covered by the dielectric layer.

The volume resistivity of the dielectric layer 48 may be greater than the volume resistively ($10^2$ to $10^{10}$ Ω.cm) of the blade 44 and is preferably $10^{12}$ Ω.cm or more. In this case, it is preferable that a thickness of the dielectric layer 48 is 30 μm or less. The dielectric layer 48 is preferably made of fluororesin (for example, PFA, i.e. perfluoro-alkoxy).

As is in the embodiment 2, by providing the dielectric layer 48 on the area from the transfer nip to the downstream portion of the conductive blade 44, when the toner image is transferred from the photosensitive drum 1 to the recording material supported on the transfer drum 8, the charging action of the blade 44 at the downstream side of the transfer nip is prevented, with the result that the toner scattering and the transfer void due to the abnormal discharge (which conventionally caused problems) can easily be prevented.

Embodiment 3

In the above-mentioned embodiments, while an example of the image forming apparatus in which the image is obtained by directly transferring the toner image formed on the photosensitive drum onto the recording material was explained, the present invention is not limited to such an example.

That is to say, in an image forming apparatus in which there is provided a second image bearing member (intermediate transfer belt, intermediate transfer drum or the like) rotated while contacting with a first image bearing member (photosensitive drum), and a toner image formed on the first image bearing member is transferred onto the second image bearing member and then the toner image is further transferred from the second image bearing member onto a recording material, the present invention can be applied to a transfer charge member urged against the first image bearing member via the second image bearing member and adapted to transfer the toner image from the first image bearing member to the second image bearing member.

Figure 3:
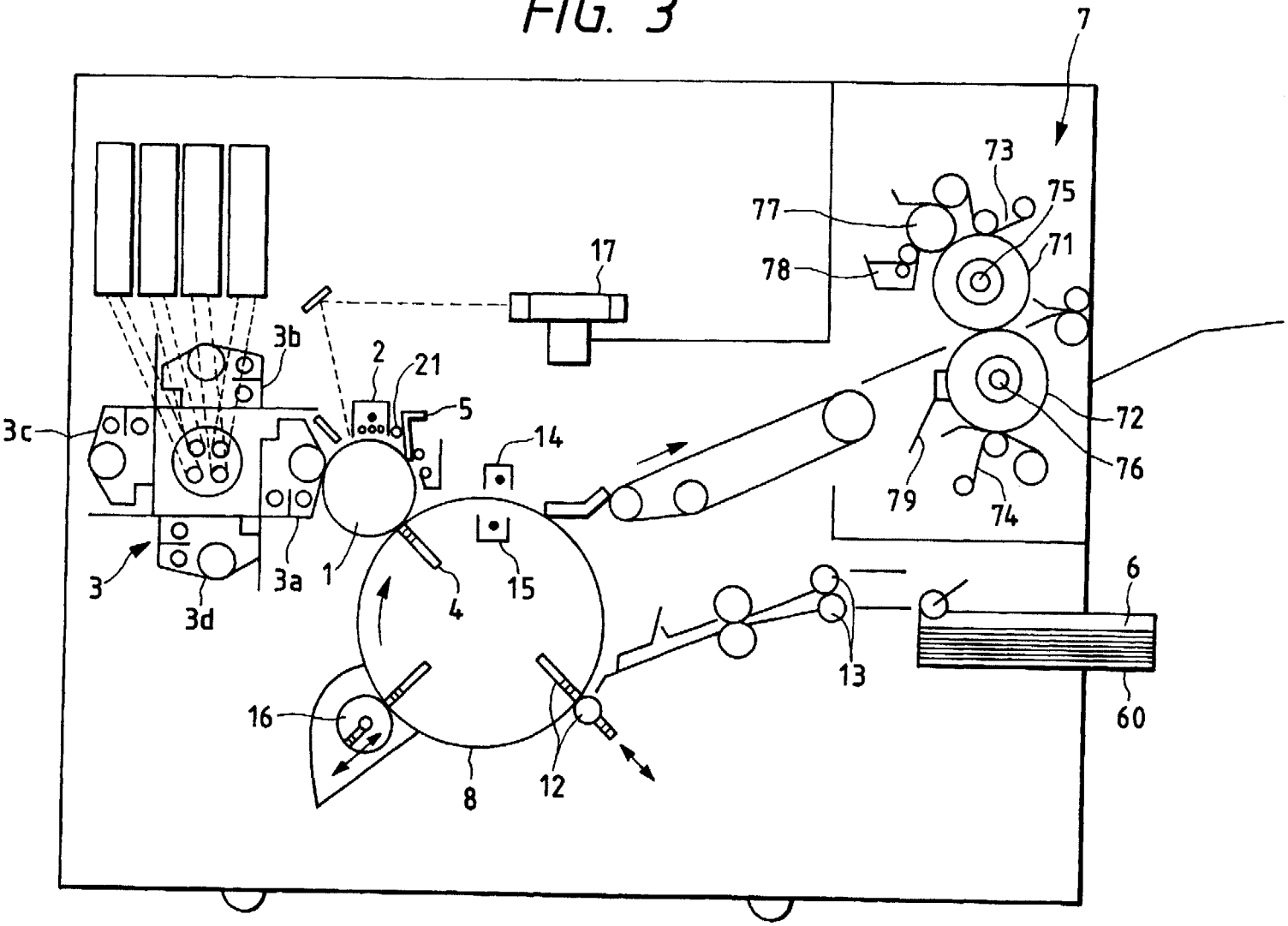
FIG. 3 is a sectional view of an electrophotographic color recording apparatus as an example of an image forming apparatus.
Figure 4:
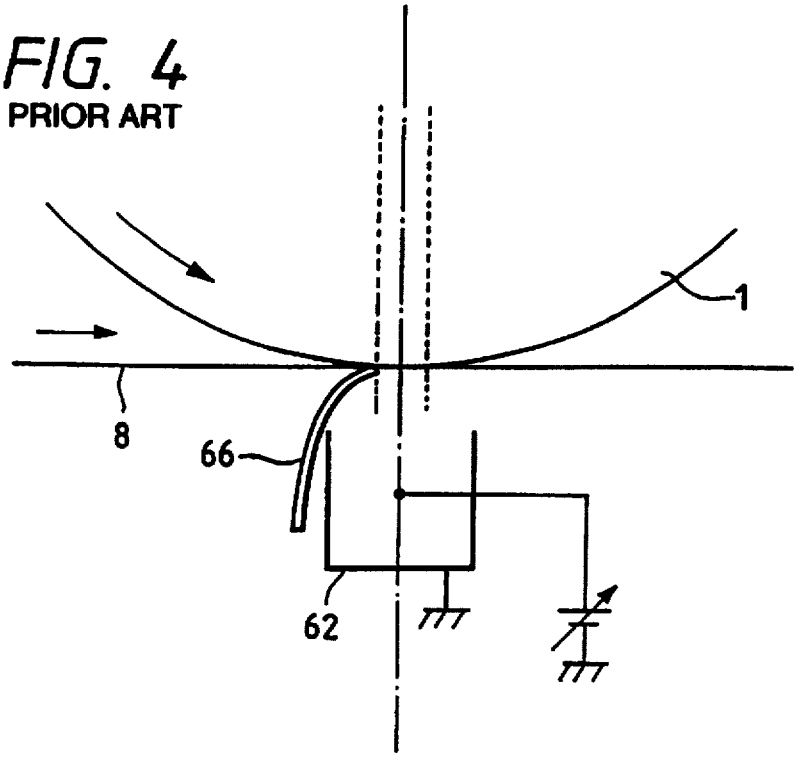
FIG. 4 PRIOR ART
FIG. 4 is a sectional view of a conventional transfer portion using a corotron transfer charger.

More specifically, in FIG. 3, the first image bearing member is constituted by the photosensitive drum 1 and the second image bearing member (intermediate transfer member) is constituted by the transfer drum 8, and plural color toner images are successively transferred from the photosensitive drum 1 onto the transfer drum 8 by the transfer charge means 4, and the toner images on the transfer drum 8 are transferred onto a recording material such as a paper sheet by a transfer means (not shown).

In the above embodiments 1 and 2, while an example that the single photosensitive drum and the single transfer drum are used was explained, a plurality of photosensitive drums and a single transfer belt may be used so that the transfer charge member and the electric field regulating member shown in the embodiment 1 (FIG. 1) or the embodiment 2 (FIG. 2) can be applied to each of transfer portions to successively transfer the toner images formed on the plural photosensitive drums onto the recording material supported on the transfer drum.

What is claimed is:

1. An image forming apparatus comprising:

an image bearing member;

a recording material bearing member for bearing and conveying a recording material to a transfer position; and a transfer charge member for transferring an image from said image bearing member onto a recording material borne on said recording material bearing member, said transfer charge member having a plate-shaped conductive substrate and being contacted with a surface of said recording material bearing member opposite to a surface thereof for bearing the recording material at the transfer position, the conductive substrate having an opposing surface spaced apart from and being opposed to said recording material bearing member, downstream of a contact position between said recording material bearing member and said transfer charge member in a convey direction of the recording material at the transfer position, and said transfer charge member having an electric field regulating member provided on the opposing surface of conductive substrate for regulating a transfer electric field generated by the conductive substrate.

2. An image forming apparatus according to claim 1, wherein said electric field regulating member has a dielectric layer provided on said conductive substrate.

3. An image forming apparatus according to claim 1 or 2, wherein said transfer charge member is provided with a second electric field regulating member for regulating the transfer electric field upstream of said contact position in a convey direction of the recording material at the transfer position.

4. An image forming apparatus according to claim 2, wherein said dielectric layer is contacted with said recording material bearing member.

5. An image forming apparatus according to claim 2, wherein said dielectric layer has a thickness of 30 μm or less.

6. An image forming apparatus according to claim 3, wherein said second regulating member has a dielectric layer provided on said conductive substrate.

7. An image forming apparatus according to claim 1, wherein an angle between said transfer charge member and said recording material bearing member and upstream of the contact portion in a convey direction of the recording material at the transfer position is an acute angle.

8. An image forming apparatus according to claim 1 or 7, wherein said transfer charge member is provided with a dielectric layer disposed on a side surface of said conductive substrate and downstream of said contact position in a convey direction of the recording material at the transfer position.

9. An image forming apparatus according to claim 1, wherein plural different color toner images can be transferred onto the recording material born on said recording material bearing member in a superimposed fashion.

10. An image forming apparatus according to claim 1, wherein the opposing surface makes a predetermined angle relative to a tangent of said image bearing member at the contact point.

11. An image forming apparatus comprising:

an image bearing member;

a recording material bearing member for bearing and conveying a recording material to a transfer position; and a transfer charge member for transferring an image from said image bearing member onto a recording material born on said recording material bearing member, said transfer charge member having a plate shape and being contacted with a surface of said recording material bearing member opposite to a surface for bearing the recording material at said transfer position;

wherein said transfer charge member has an abutment portion urged against said recording material bearing member, which abutment portion has an acute angle in the plane perpendicular to the generatrix of said image bearing member.

12. An image forming apparatus according to claim 11, wherein said transfer charge member includes a plate-shaped conductive substrate.

13. An image forming apparatus according to claim 12, wherein said conductive substrate is opposed to said recording material bearing member downstream of said abutment portion in a convey direction of the recording material at the transfer position.

14. An image forming apparatus according to claim 12, wherein said transfer charge member is provided with an electric field regulating member for regulating a transfer electric field generated by said conductive substrate upstream of said abutment portion in a convey direction of the recording material at the transfer position.

15. An image forming apparatus according to claim 14, wherein said regulating member has a dielectric layer provided on said conductive substrate.

16. An image forming apparatus according to claim 11, wherein an angle between said transfer charge member and said recording material bearing member and upstream of the contact portion in the convey direction of the recording material at the transfer position is an acute angle.

17. An image forming apparatus according to claim 11, wherein plural different color toner images can be transferred onto the recording material born on said recording material bearing member in a superimposed fashion.

18. An image forming apparatus comprising:

an image bearing member;

a rotatable intermediate transfer member;

a transfer charge member for transferring an image from said image bearing member onto said intermediate transfer member at a transfer position, said transfer charge member having a plate-shaped conductive substrate and being contacted with a surface of said intermediate transfer member opposite to a surface thereof for bearing the recording material at the transfer position, the conductive substrate having an opposing surface spaced apart from and opposed to said recording material bearing member, downstream of a contact position between said intermediate transfer member and said transfer charge member in a rotating direction of said intermediate transfer member at the transfer position, and said transfer charge member having an electric field regulating member provided on the opposing surface of conductive substrate for regulating a transfer electric field generated by the conductive substrate.

19. An image forming apparatus according to claim 18, wherein said electric field regulating member comprises a dielectric layer provided on said conductive substrate.

20. An image forming apparatus according to claim 18 or 19, wherein said transfer charge member is provided with a second electric field regulating member for regulating the transfer electric field upstream of said contact position in the rotation direction of said intermediate transfer member at the transfer position.

21. An image forming apparatus according to claim 19, wherein said dielectric layer is contacted with said intermediate transfer member.

22. An image forming apparatus according to claim 19, wherein said dielectric layer has a thickness of 30 μm or less.

23. An image forming apparatus according to claim 20, wherein said second regulating member has a dielectric layer provided on said conductive substrate.

24. An image forming apparatus according to claim 18, wherein an angle between said transfer charge member and said intermediate transfer member and upstream of the contact portion in the rotation direction of said intermediate transfer member at the transfer position is an acute.

25. An image forming apparatus according to claim 18 or 24, wherein said transfer charge member is provided with a dielectric layer disposed on a side surface of said conductive substrate and downstream of said contact position in the rotation direction of said intermediate transfer member at the transfer position.

26. An image forming apparatus according to claim 18, wherein plural different color toner images can be transferred onto said intermediate transfer member in a superimposed fashion.

27. An image forming apparatus according to claim 18, wherein the opposing surface makes a predetermined angle relative to a tangent of said image bearing member at the contact point.

28. An image forming apparatus comprising:

an image bearing member;

an intermediate transfer member; and a transfer charge member for transferring an image from said image bearing member onto the recording material born on said recording material bearing member at a transfer position, said transfer charge member having a plate shape and being contacted with a surface of said intermediate transfer member opposite to a surface for bearing the recording material at said transfer position, wherein said transfer charge member has an abutment portion abutted against said recording material bearing member, which abutment portion has an acute angle in the plane perpendicular to the generatrix of said image bearing member.

29. An image forming apparatus according to claim 28, wherein said transfer charge member includes a plate-shaped conductive substrate.

30. An image forming apparatus according to claim 29, wherein said conductive substrate is opposed to said intermediate transfer member downstream of said abutment portion in a rotation direction of said intermediate transfer member at the transfer position.

31. An image forming apparatus according to claim 29, wherein said transfer charge member is provided with an electric field regulating member for regulating a transfer electric field generated by said conductive substrate upstream of said abutment portion in a rotation direction of said intermediate transfer member at the transfer position.

32. An image forming apparatus according to claim 31, wherein said regulating member has a dielectric layer provided on said conductive substrate.

33. An image forming apparatus according to claim 28, wherein an angle between said transfer charge member and said intermediate transfer member and upstream of the contact portion in the rotation direction of said intermediate transfer member at the transfer position is an acute.

34. An image forming apparatus according to claim 28, wherein plural different color toner images can be transferred onto said intermediate transfer member in a superimposed fashion.

* * * * *

UNITED STATES PATENT AND TRADEMARK OFFICE

CERTIFICATE OF CORRECTION

PATENT NO. : 5,713,066

DATED : January 27, 1998

INVENTOR(S) : TAKEKOSHI et al.

It is certified that error appears in the above-identified patent and that said Letters Patent is hereby corrected as shown below:

Column 1

Line 16, "plurality" should read --a plurality of--.

Column 3

Line 54, "regist" should read --register--.

Column 7

Line 2, "not may" should read --may not--.

Column 8

Line 9, "the conductive substrate" should read --said conductive substrate--.
Line 12, "convey" should read --conveying--.
Line 16, "of" should read --of said--.
Line 26, "convey" should read --conveying--.
Line 39, "convey" should read --conveying--.
Line 45, "convey" should read --conveying--.
Line 49, "born" should read --borne--.
Line 62, "born" should read --borne--.

COLUMN 9

Line 2, "urged" should read --abutted--.
Line 11, "convey" should read --conveying--.
Line 17, "convey" should read --conveying--.
Line 25, "convey" should read --conveying--.

UNITED STATES PATENT AND TRADEMARK OFFICE

CERTIFICATE OF CORRECTION

PATENT NO. : 5,713,066

DATED : January 27, 1998

INVENTOR(S) : TAKEKOSHI et al.

It is certified that error appears in the above-identified patent and that said Letters Patent is hereby corrected as shown below:

Column 9

Line 29, "born" should read --borne--.
Line 42, "the conductive substrate" should read --said conductive substrate--.
Line 51, "of" should read --of said--.

COLUMN 10

Line 8, "acute." should read --acute angle.--
Line 29, "born" should read --borne--.
Line 61, "acute." should read --acute angle.--

Signed and Sealed this

Fifteenth Day of September, 1998

Bruce Lehman

*Attest:*

BRUCE LEHMAN

*Attesting Officer*

*Commissioner of Patents and Trademarks*